US010663918B2

(12) United States Patent
Kim et al.

(10) Patent No.: US 10,663,918 B2
(45) Date of Patent: May 26, 2020

(54) SUPPORT DEVICE AND IMAGE FORMING APPARATUS HAVING THE SAME

(71) Applicant: Hewlett-Packard Development Company, L.P., Spring, TX (US)

(72) Inventors: Mintae Kim, Suwon-si (KR); Seongho Park, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/385,154

(22) Filed: Apr. 16, 2019

(65) Prior Publication Data

US 2019/0243304 A1 Aug. 8, 2019

Related U.S. Application Data

(63) Continuation of application No. PCT/KR2017/002472, filed on Mar. 7, 2017.

(30) Foreign Application Priority Data

Oct. 18, 2016 (KR) ..... 10-2016-0135128

(51) Int. Cl.
*G03G 21/18* (2006.01)
*G03G 21/16* (2006.01)

(52) U.S. Cl.
CPC ..... *G03G 21/1853* (2013.01); *G03G 21/1633* (2013.01); *G03G 21/1647* (2013.01); *G03G 2221/1684* (2013.01); *G03G 2221/1869* (2013.01)

(58) Field of Classification Search
CPC ..... G03G 21/1853; G03G 21/1633; G03G 21/1647; G03G 2221/1684; G03G 2221/1869
See application file for complete search history.

(56) References Cited

U.S. PATENT DOCUMENTS

2010/0080614 A1 4/2010 Yamaguchi et al.
2010/0080617 A1* 4/2010 Noguchi ..... G03G 21/1853 399/112
2013/0189014 A1 7/2013 Mori
2013/0223876 A1 8/2013 Sakurai et al.
2014/0205309 A1 7/2014 Kawasumi
2015/0331385 A1 11/2015 Fujinaka et al.

* cited by examiner

*Primary Examiner* — David M. Gray
*Assistant Examiner* — Michael A Harrison
(74) *Attorney, Agent, or Firm* — Jefferson IP Law, LLP

(57) ABSTRACT

A support device and an image forming apparatus having the same are provided. The support device according to an example includes a first lever rotatably disposed at a door provided in a body of an image forming apparatus, and a first elastic member to rotate the first lever disposed at a first position based on the door being closed to a second position based on the door being opened, wherein, at the second position, the first lever supports a part of a toner cartridge tray pulled out from the body.

20 Claims, 17 Drawing Sheets

(a) (b)

SUPPORT DEVICE AND IMAGE FORMING APPARATUS HAVING THE SAME

BACKGROUND

An image forming apparatus is an apparatus for generating an image on a print medium. Representative examples include a printer, a copier, a facsimile, a scanner, and a multifunction printer that integrally implements these functions.

An image forming apparatus may include a door provided on one side of a body. By opening the door, a user may access a toner cartridge tray that is mounted to be movable inside and outside of the body of the image forming apparatus. The toner cartridge tray may support a plurality of developing units such that, if a developing unit runs out of a developer, a user may open the door and extend the toner cartridge tray outside of the body to replace or refill the developing unit. The toner cartridge tray may slide on a guide rail, provided inside the image forming apparatus, to be moved inside and outside of the body.

DETAILED DESCRIPTION OF EXEMPLARY EMBODIMENTS

Figure 1:
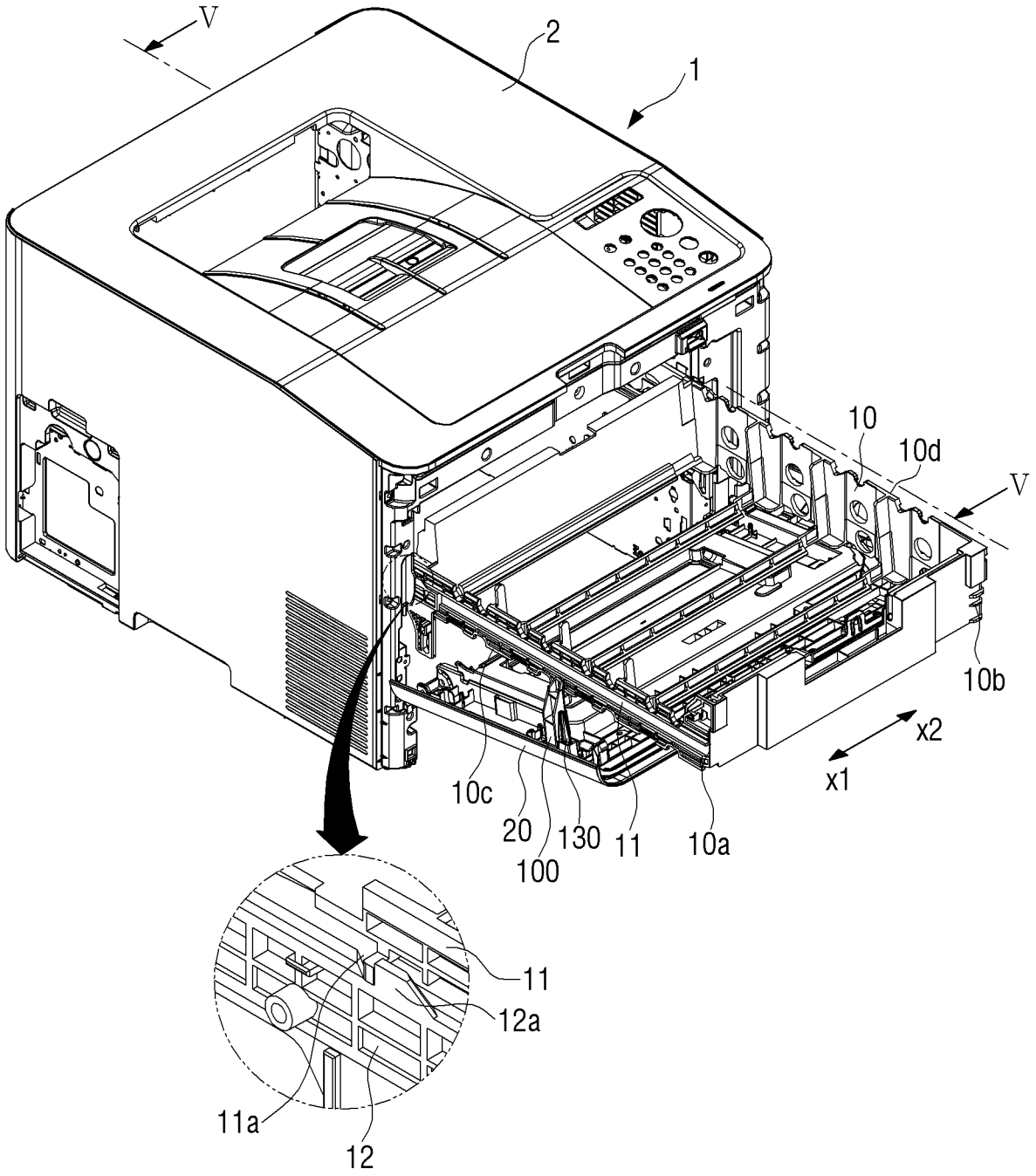
FIG. 1 is a perspective view illustrating an image forming apparatus including a support device according to an example.

Various examples will be described below with reference to the accompanying drawings. It is to be understood that the disclosure herein is not intended to limit the scope of the disclosure to the specific examples but may include various modifications, equivalents, and/or alternatives of the examples. In the description of the drawings, like reference numerals refer to like elements throughout the description of drawings.

The expression "image forming apparatus" may refer to a device for printing print data generated from a terminal such as a computer on a recoding paper. Examples of an image forming apparatus may include as a printer, a copier, a scanner, a facsimile, a multifunction printer (MFP) that integrally implements these functions through a single device, and the like. The image forming apparatus may refer to any device capable of performing an image forming task, such as the copier, the printer, the scanner, the fax machine, the multi-function printer (MFP), or a display.

Hereinafter, a support device according to an example will be described with reference to FIGS. 1 to 5.

Figure 2:
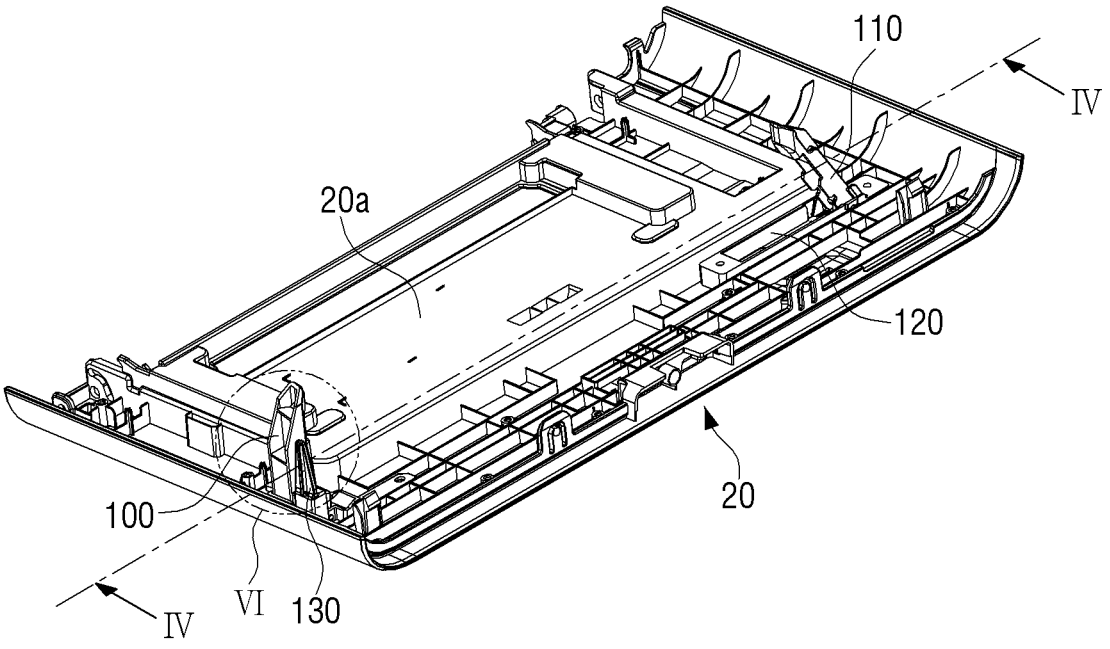
FIG. 2 is a perspective view illustrating a door including a support device according to an example.
Figure 3:
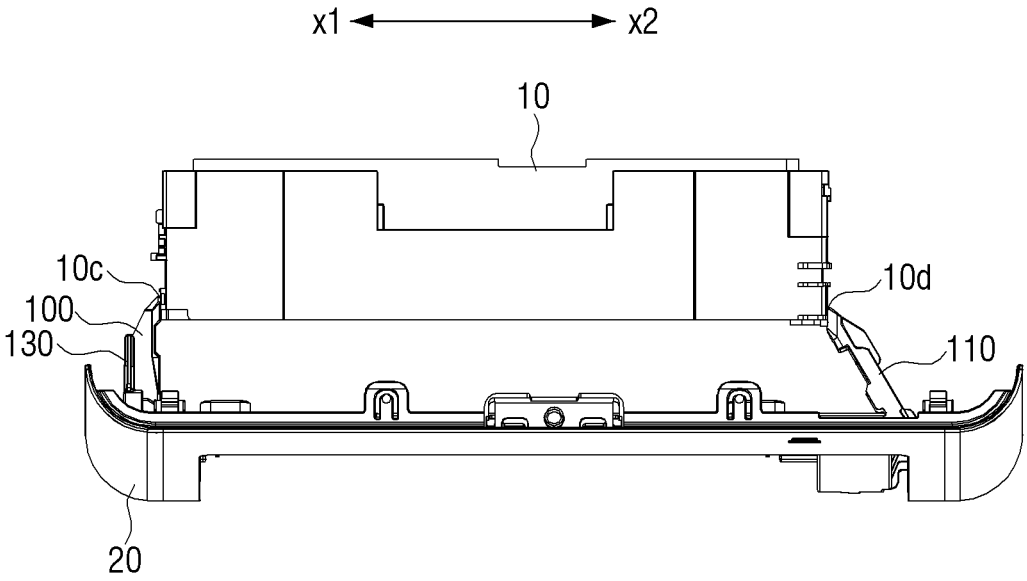
FIG. 3 is a front view illustrating a support device that supports a toner cartridge tray according to an example.
Figure 4A:
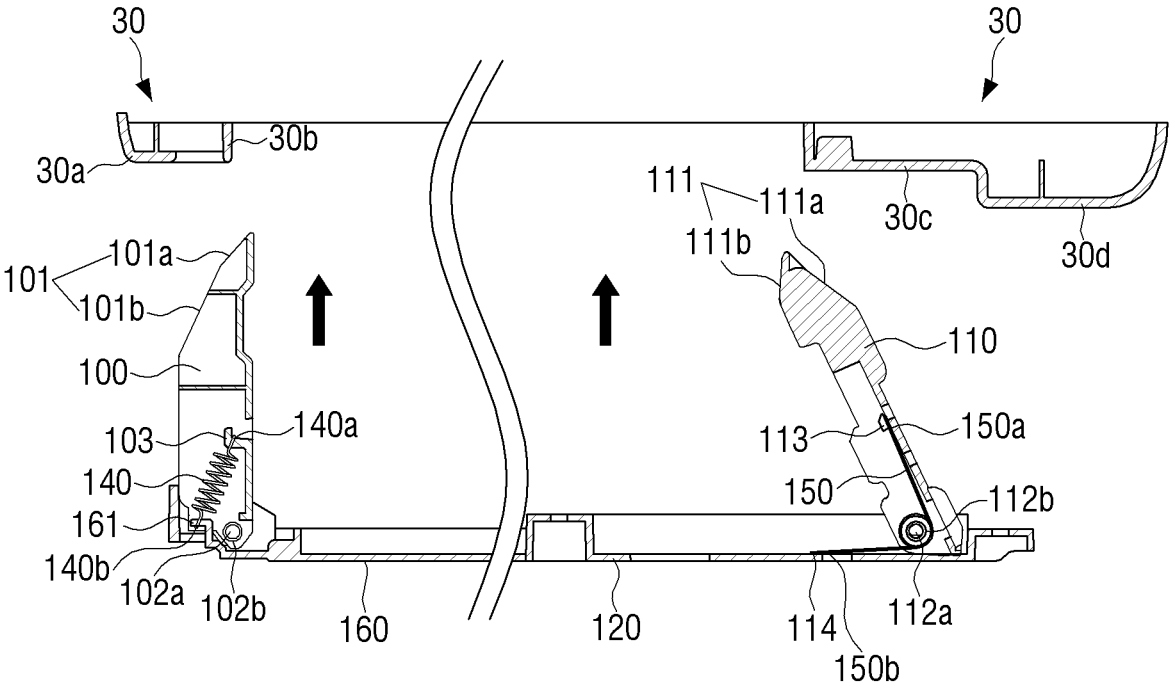
FIG. 4A is a cross-sectional view taken along line IV of FIG. 2 illustrating a support device that operates when a door is closed according to an example.
Figure 4B:
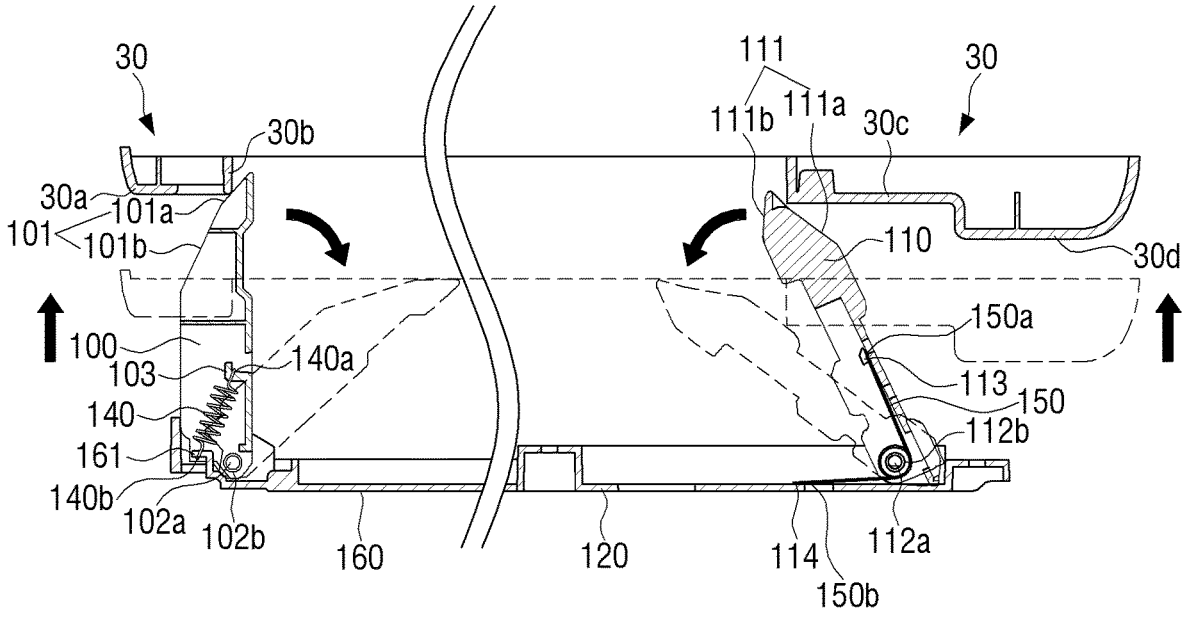
FIG. 4B is a cross-sectional view taken along line IV of FIG. 2 illustrating a support device that operates when a door is closed according to an example.
Figure 4C:
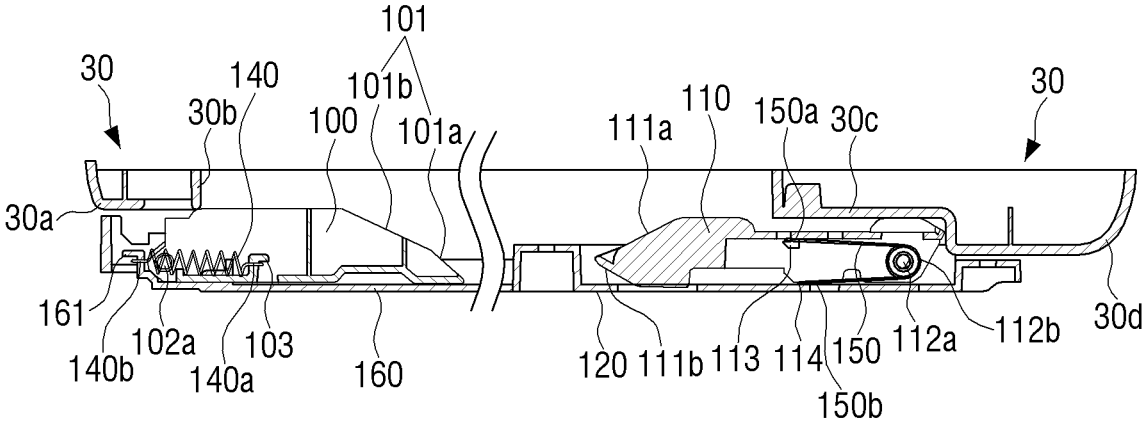
FIG. 4C is a cross-sectional view taken along line IV of FIG. 2 illustrating a support device that operates when a door is closed according to an example.
Figure 5:
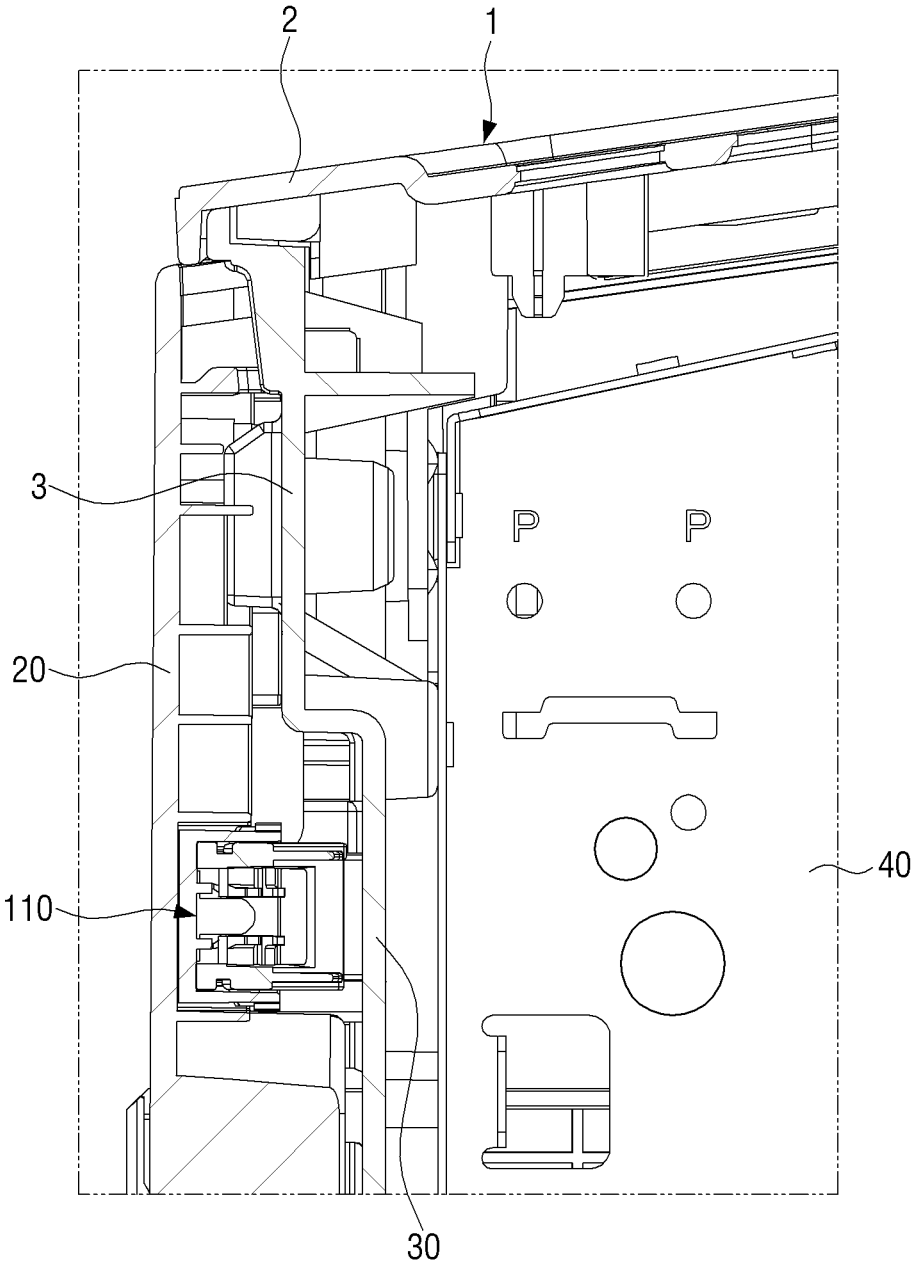
FIG. 5 is a partial enlargement view illustrating a cross-section taken along line V of FIG. 1 according to an example.

FIG. 1 is a perspective view illustrating an image forming apparatus including a support device according to an example, FIG. 2 is a perspective view illustrating a door including a support device according to an example, FIG. 3 is a front view illustrating a support device that supports a toner cartridge tray according to an example, FIG. 4A, FIG. 4B, and FIG. 4C are cross-sectional views taken along line IV of FIG. 2 illustrating a support device that operates when a door is closed according to an example, and FIG. 5 is a partial enlargement view illustrating a cross-section taken along line V of FIG. 1 according to an example.

Referring to FIG. 1, an image forming apparatus 1 may include a body 2, a door 20 provided on one side of the body 2, a photosensitive medium (not shown) on which an electrostatic latent image is formed, a developing unit (not shown) for forming the electrostatic latent image of the photosensitive medium into a visible image, a transfer unit (not shown) for transferring the visible image to a recording medium, and a fixing unit (not shown) for fixing the image transferred to the recording medium therein.

The image forming apparatus 1 may include a toner cartridge tray 10 that can be movable inside or outside of the image forming apparatus 1.

When the door 20 is opened, the toner cartridge tray 10 located in an inside 40 of the image forming apparatus 1 may be moved to the outside of the image forming apparatus 1.

A guide rail 12 may be disposed in the inside 40 of the image forming apparatus 1 so that the toner cartridge tray 10 may be slidably moved.

A guide 11 may be disposed on a left side 10*c* and a right side 10*d* of the toner cartridge tray 10, respectively extending from a left front end 10*a* and a right front end 10*b* of the toner cartridge tray 10, so that the toner cartridge tray 10 may be coupled to the guide rail 12. The guide 11 may be slidably coupled to the guide rail 12.

The guide 11 may include a deviation prevention hook 11*a* to limit the range of movement of the toner cartridge tray 10 when the toner cartridge tray 10 moves to the outside of the image forming apparatus 1.

The deviation prevention hook 11*a* may be coupled with the guide 11, and, in an example, may be integrally formed with the guide 11. When the toner cartridge tray 10 moves a predetermined distance, the deviation prevention hook 11*a* is caught by a stopper 12*a* provided in the guide rail 12, thereby limiting the range of movement to the outside of the toner cartridge tray 10.

As the movement range of the toner cartridge tray 10 is limited by the deviation prevention hook 11*a*, although the toner cartridge tray 10 is disposed outside the image forming apparatus 1, one end of the toner cartridge tray 10 may be supported by the image forming apparatus 1. Therefore, a user may easily replace an individual developer (not shown) mounted on the toner cartridge tray 10.

Referring to FIG. 1, FIG. 2, and FIG. 3, when the toner cartridge tray 10 is moved from the inside 40 to the outside of the image forming apparatus 1, the image forming apparatus 1 may include a support device in the door 20. The support device may support the toner cartridge tray 10 and may prevent the toner cartridge tray 10 from moving in an x1 or an x2 direction.

The support device may include a first lever 100 or/and a second lever 110.

Referring to FIG. 2 and FIG. 3, the first lever 100 may be arranged on one side of an inner surface 20*a* of the door 20, and the second lever 110 may be arranged on another side of the inner surface 20*a* of the door 20 opposite to the first lever 100 by a predetermined distance.

The first lever 100 may be arranged to support the left side 10*c* of the toner cartridge tray 10, and the second lever 110 may be arranged to support the right side 10*d* of the toner cartridge tray 10. However, it is not limited thereto, and the first and second levers 100 and 110 may be arranged in various manners.

Referring to FIG. 2 and FIG. 4A, an example of the first lever 100 will be described.

A front end of the first lever 100 may be a free end, and a rear end of the first lever 100 may be rotatably connected to the inner surface 20*a* of the door 20.

The first lever 100 may include an accommodator 160, and the accommodator 160 may be provided on the inner surface 20*a* of the door 20.

The accommodator 160 may be integrally embodied with the inner surface 20*a* of the door 20 but is not limited thereto. It is also possible to manufacture the accommodator 160 and couple it to the inner surface 20*a* of the door 20.

The rear end of the first lever 100 may be rotatably connected to the accommodator 160.

The first lever 100 may include a hinge protrusion 102*a*, and the accommodator 160 may include a hinge hole 102*b*. The hinge protrusion 102*a* may be inserted into the hinge hole 102*b* and form a rotational axis for rotating the first lever 100.

A first position may be defined such that the first lever 100 is located in parallel with the door 20 or provided in the accommodator 160.

In general, the first position may be formed between the door 20 and an internal structure 30 of the image forming apparatus 1 when the door 20 is closed.

The first lever 100 may be provided in a space formed between the door 20 and the internal structure 30, and thus there is no need to additionally provide a separated space for the first lever 100 in the image forming apparatus 1.

A second position may be defined such that the first lever 100 is rotated and disposed at a predetermined angle from the door 20 or the accommodator 160. In the second position, the first lever 100 may support the toner cartridge tray 10.

The first lever 100 may be perpendicular to the inner surface 20*a* of the door 20 at the second position but is not limited thereto.

The first lever 100 may be rotated between the first position and the second position based on the same rotational axis as that of the hinge protrusion 102*a*. The first lever 100 may be connected to the accommodator 160 by a first elastic member to be rotated.

According to an example, the first elastic member connecting the first lever 100 to the accommodator 160 may be a coil spring 140 but the first elastic member is not limited thereto. The first elastic member could be any type that elastically connects the first lever 100 to the accommodator 160.

According to an example, the coil spring 140 will be exemplified as the first elastic member for connecting the first lever 100 to the accommodator 160.

Referring to FIG. 4A, one end 140*a* of the coil spring 140 may be connected to a first loop 103 of the first lever 100. The other end 140*b* of the coil spring may be connected to a second loop 161 provided in the accommodator 160.

When the first lever 100 is disposed at the first position, a distance between the first loop 103 and the second loop 161 may be greater than a distance between the first loop 103 and the second loop 161 when the first lever 100 is disposed at the second position. Therefore, the coil spring 140 may be extended by the first loop 103.

When the first lever 100 is disposed at the second position, the distance between the first loop 103 and the second loop 161 may be smaller than the distance between the first loop 103 and the second loop 161 when the first lever 100 is disposed at the first position. Therefore, a length of the coil spring 140 may return to an original state due to a restoring force.

The first lever 100 may be disposed at the first position when the door 20 is closed, and when the door 20 is opened, may rotate to the second position automatically due to the restoring force of the coil spring 140.

A slope 101 may be formed in a length direction of the first lever 100 on a side of the front end of the first lever 100, and the slope 101 may include a first slope 101*a* and a second slope 101*b*.

Referring to FIG. 4A, FIG. 4B, FIG. 4C, and FIG. 5, the slope 101 formed on the side of the front end of the first lever 100 may contact the internal structure 30 of the image forming apparatus 1 so as to rotate the first lever 100 from the second position to the first position.

The slope 101 formed on one surface of the first lever 100 may incline at different angles so that the first slope 101*a* and the second slop 101*b* are formed having different angles. However, the disclosure is not limited thereto. For example, only one of the first slope 101*a* and the second slope 101*b* may be included.

An example operation of the first lever 100 according to the closing of the door 20 will be described below.

Referring to FIG. 2 and FIG. 4A, an example of the second lever 110 will be described.

A front end of the second lever 110 may be a free end, and a rear end thereof may be hingedly connected to the inner surface 20*a* of the door 20.

The second lever 110 may further include a holder 120 for accommodating the second lever 110, and the holder 120 may be provided in the inner surface 20*a* of the door 20.

The holder 120 may be coupled with the inner surface 20*a* of the door 20. In an example, the holder 120 may be integrally formed with the inner surface 20*a* of the door 20 but it is also possible to separately manufacture the holder 120 to be coupled to the inner surface 20*a* of the door 20.

The rear end of the second lever 110 may be hingedly connected to the holder 120.

A hinge protrusion 112*a* may be formed in the second lever 110, and a hinge hole 112*b* may be formed in the holder 120. The hinge protrusion 112*a* may be inserted into the hinge hole 112*b* to form a rotational axis for rotating the second lever 110.

A third position may be defined such that the second lever 110 may be located in parallel with the door 20 or provided in the holder 120.

In the third position, the second lever 110 may be located between the door 20 and the internal structure 30 of the image forming apparatus 1 when the door 20 is closed.

Therefore, the second lever 110 may be provided in a space formed between the door 20 and the internal structure 30, and thus there is no need to add a separate space to accommodate the second lever 110 in the image forming apparatus 1.

A fourth position may be defined such that the second lever 110 is rotated at a predetermined angle with the inner surface 20*a* of the door 20 or the holder 120 to support the toner cartridge tray 10.

In an example, an angle between the second lever 110 and the inner surface 20*a* of the door 20 or the holder 120 may be other than 90 degrees so as to suppress the movement of the toner cartridge tray 10 in the direction of x1 or x2. Therefore, an angle between the second lever 110 and the inner surface 20*a* of the door 20 or the holder 120 may be less than 90 degrees or greater than 90 degrees when the second lever 110 is disposed at the fourth position. However, the disclosure is not limited thereto, and the angle could vary.

The second lever 110 may be rotated between the third position and the fourth position based on the same rotational axis as that of the hinge protrusion 112*a*. The second lever 110 may be connected to the holder 120 by a second elastic member to be rotated.

In a support device according to an example, the second elastic member connecting the second lever 110 to the holder 120 may be a torsion spring 150, but another type of elastic member could be used as long as it elastically supports the second lever 110 from the inner surface 20*a* of the door 20 or the holder 120.

According to an example, the torsion spring 150 will be exemplified as the second elastic member for connecting the second lever 110 to the holder 120.

Referring to FIG. 4A, one end 150*a* of the torsion spring 150 may be fixed to the second lever 110 by a fixing portion 113 formed on the second lever 110. The other end 150*b* of the torsion spring 150 may be connected to an inner wall 114 of the holder 120.

When the door 20 is closed, the second lever 110 may be disposed at the third position.

A distance between the fixing portion 113 and the inner wall 114 of the holder 120 when the second lever 110 is disposed at the third position may be smaller than a distance between the fixing portion 113 and the inner wall 114 of the holder 120 when the second lever 110 is disposed at the fourth position.

The shape of the torsion spring 150 may be changed to place the second lever 110 at the third position.

When the door 20 is opened, the second lever 110 may be rotated based on the hinge protrusion 112*a* by the elasticity of the torsion spring 150, which returns to an original shape, and moved to the fourth position.

A slope 111 may be formed in a length direction of the second lever 110 at the front end of the second lever 110, and the slope 111 may include a forward slope 111*b* and a rearward slope 111*a*.

Referring to FIG. 4A, FIG. 4B, FIG. 4C, and FIG. 5, the rearward slope 111*a* formed on the front end of the second lever 110 may contact the internal structure 30 of the image forming apparatus 1 to rotate the second lever 110 from the fourth position to the third position.

Therefore, the rearward slope 111*a* formed at the front end of the second lever 110 inclines gently rather than steeply.

Referring to FIG. 4A, FIG. 4B, FIG. 4C, and FIG. 5, the driving of the first and second levers 100 and 110 when the door 20 is closed will be described.

Referring to FIG. 4A, when the door 20 is opened, the first lever 100 may automatically rotate from the first position to the second position based on the hinge protrusion 102*a* by the coil spring 140 provided in the first lever 100.

The second lever 110 may automatically rotate from the third position to the fourth position based on the hinge protrusion 112*a* by the torsion spring 150 provided in the second lever 110.

The first lever 100 disposed at the second position and the second lever 110 disposed at the fourth position may respectively support the left side 10*c* and the right side 10*d* of the toner cartridge tray 10.

Referring to FIG. 4B, when the door 20 is close to the internal structure 30, the first slope 101*a* formed on the side of the front end of the first lever 100 may contact a first contact part 30*b* of the internal structure 30. The rearward slope 111*a* formed at the front end of the second lever 110 may contact a second contact part 30*c* of the internal structure 30.

As the door 20 is close to the internal structure 30, the first and second contact parts 30*b* and 30*c* formed in the internal structure 30 may rotate the first lever 100 to the first position, and the second lever 110 to the third position.

The first and second contact parts 30*b* and 30*c* may be coupled with left and right frames 30*a* and 30*d* of the internal structure 30. In an example, the first and second contact parts 30*b* and 30*c* may be integrally formed with left and right frames 30*a* and 30*d* of the internal structure 30.

The left and right frames 30*a* and 30*d* of the internal structure 30 may be arranged to be close to the door 20 when the door 20 is closed to separate the inside 40 of the image forming apparatus 1 from the outside, and protect components arranged in the image forming apparatus 1.

Referring to FIG. 4C, when the door 20 is completely closed, such as by an external force, the first contact part 30*b* may continuously apply a force to the first lever 100 and maintain the first lever 100 to be disposed at the first position.

The second contact part 30*c* may continuously apply a force to the second lever 110 and maintain the second lever 110 to be disposed at the third position.

The first and second levers 100 and 110 may be disposed horizontally.

Referring to FIG. 5, when the second lever 110 is moved to the third position as the door 20 is closed, the second lever 110 may be connected to an internal frame 3 of the image forming apparatus 1 and provided in a space between the internal structure 30 and the door 20.

The first lever 100 may be provided in a space formed opposite to the position where the second lever 110 is provided.

The first and second levers 100 and 110 may be provided in a space formed between the internal structure 30 and the door 20. Therefore, it is not necessary to increase a size or a volume of the image forming apparatus 1.

Figure 6:
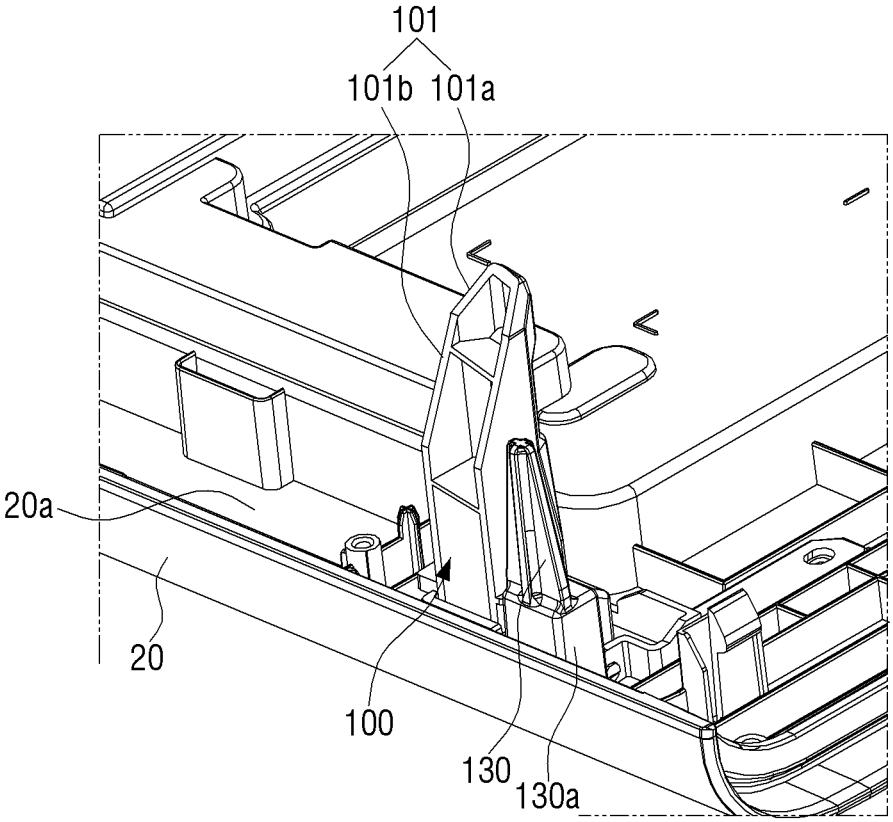
FIG. 6 is a partial enlargement view of section VI of FIG. 2 according to an example.
Figure 7:
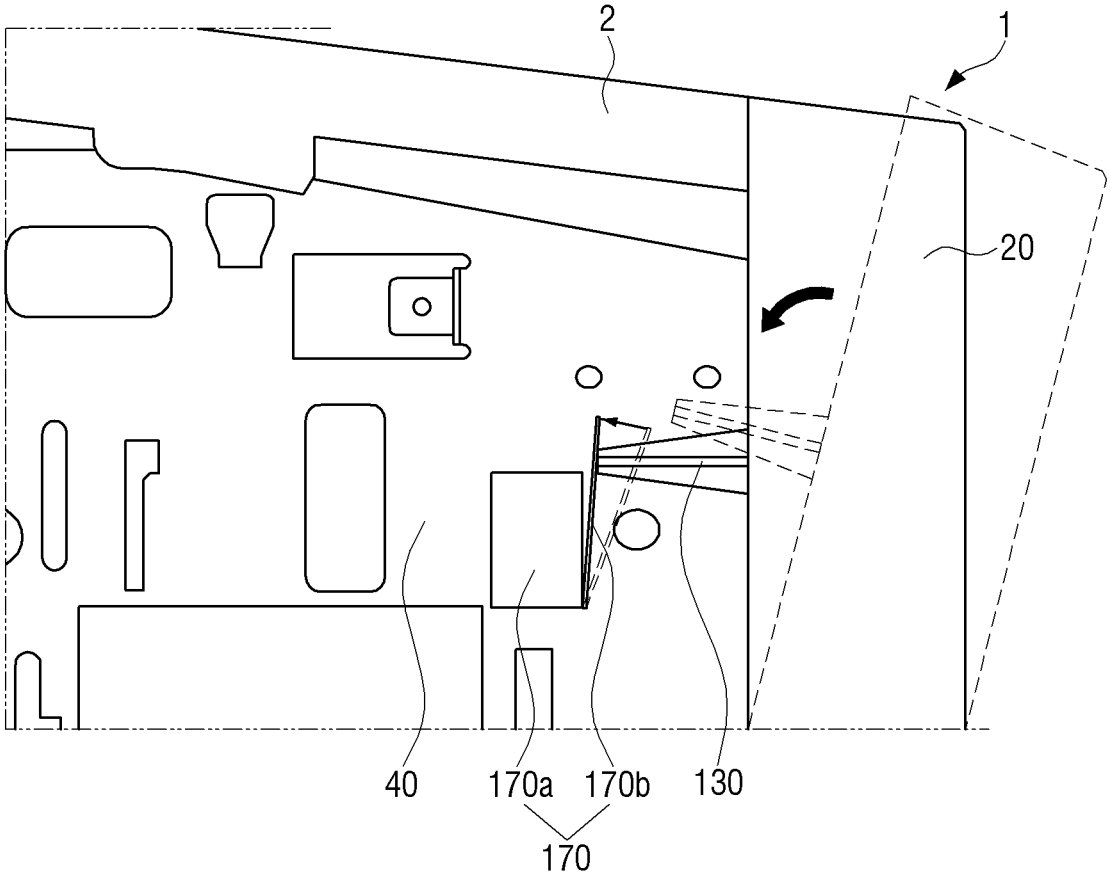
FIG. 7 is a schematic cross-sectional view illustrating a push protrusion that operates according to an opening and a closing of a door according to an example.

Referring to FIG. 6 and FIG. 7, a support device according to an example will be described.

A support device according to the example of FIG. 6 and FIG. 7 is similar to the above described support device but further includes a push protrusion. Therefore, only the description of the push protrusion will be made.

FIG. 6 is a partial enlargement view of section VI of FIG. 2 according to an example, and FIG. 7 is a schematic cross-sectional view illustrating a push protrusion that operates according to an opening and a closing of a door according to an example.

Referring to FIG. 6, a support device may further include a push protrusion 130.

The push protrusion 130 may be provided in the inner surface 20*a* of the door 20, and coupled with the door 20. In an example, the push protrusion 130 may be integrally formed with the door 20.

In an example, the push protrusion 130 may further include a support 130*a* to protrude further from the inner surface 20*a* of the door 20.

The support 130*a* may be coupled with the push protrusion 130 and the door 20 and provided in the inner surface 20*a* of the door 20. In an example, the support 130*a* may be integrally formed with the push protrusion 130 and the door 20.

Referring to FIG. 7, the image forming apparatus 1 may further include a sensor 170 in the inside 40 of the image forming apparatus 1 for sensing whether the door 20 is opened or closed.

The sensor 170 may include a sensing part 170*a* and a switch 170*b*.

The switch 170*b* may be elastically connected to the sensing part 170*a*, and include a material having elasticity.

The sensing part 170*a* may sense whether the door 20 is opened or closed based on how close the switch 170*b* is to the sensing part 170*a*.

Referring to FIG. 7, example operations of the push protrusion 130 and the sensor 170 according to the opening and closing of the door 20 will be described as below.

When the door 20 is closed, the push protrusion 130 may contact the switch 170*b* and push the switch 170*b* toward the sensing part 170*a*.

The switch 170*b* may be close to the sensing part 170*a* by the push protrusion 130, and the sensing part 170*a* may sense that the door 20 is closed.

When the door 20 is opened, the push protrusion 130 may be apart from the switch 170*b*, and the switch 170*b* may be spaced apart from the sensing part 170*a*. The sensing part 170*a* may sense that the door 20 is opened.

Figure 8:
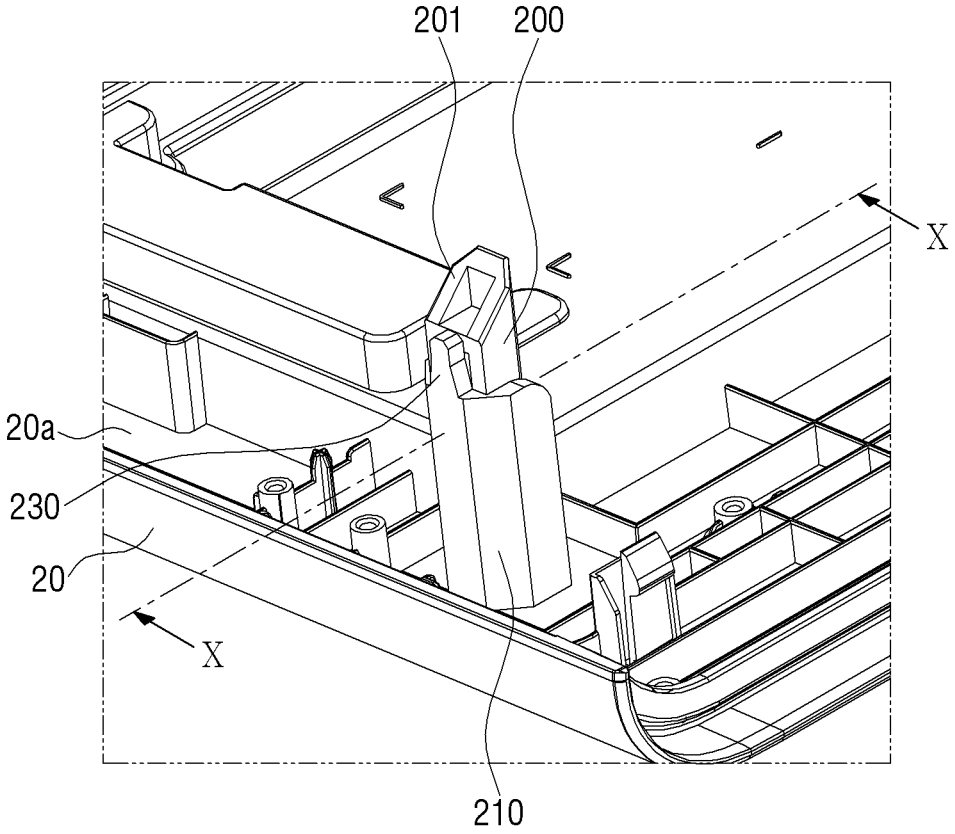
FIG. 8 is a perspective view illustrating a first lever and a push protrusion according to an example.
Figure 9:
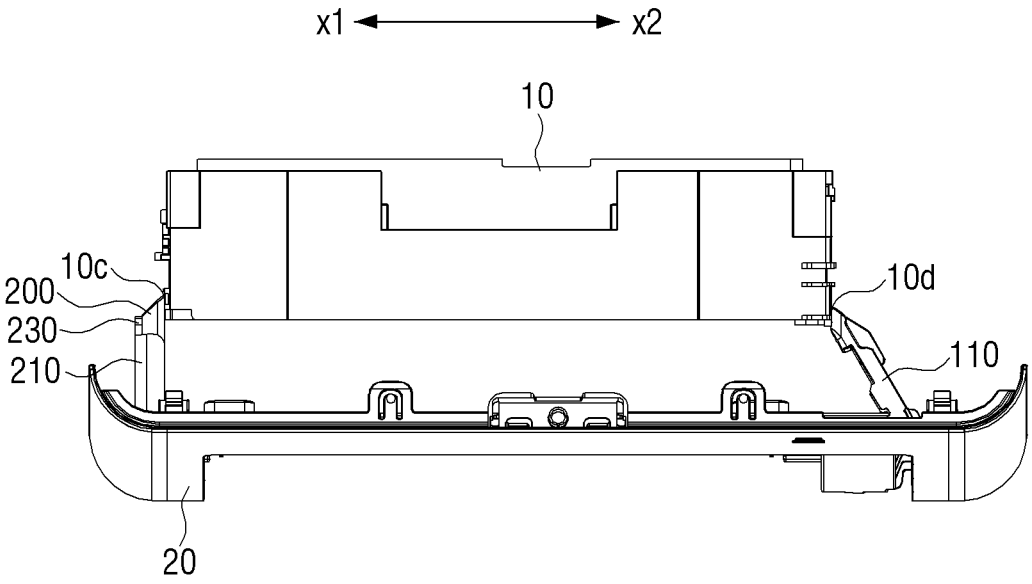
FIG. 9 is a front view illustrating a support device that supports a toner cartridge tray according to an example.
Figure 10:
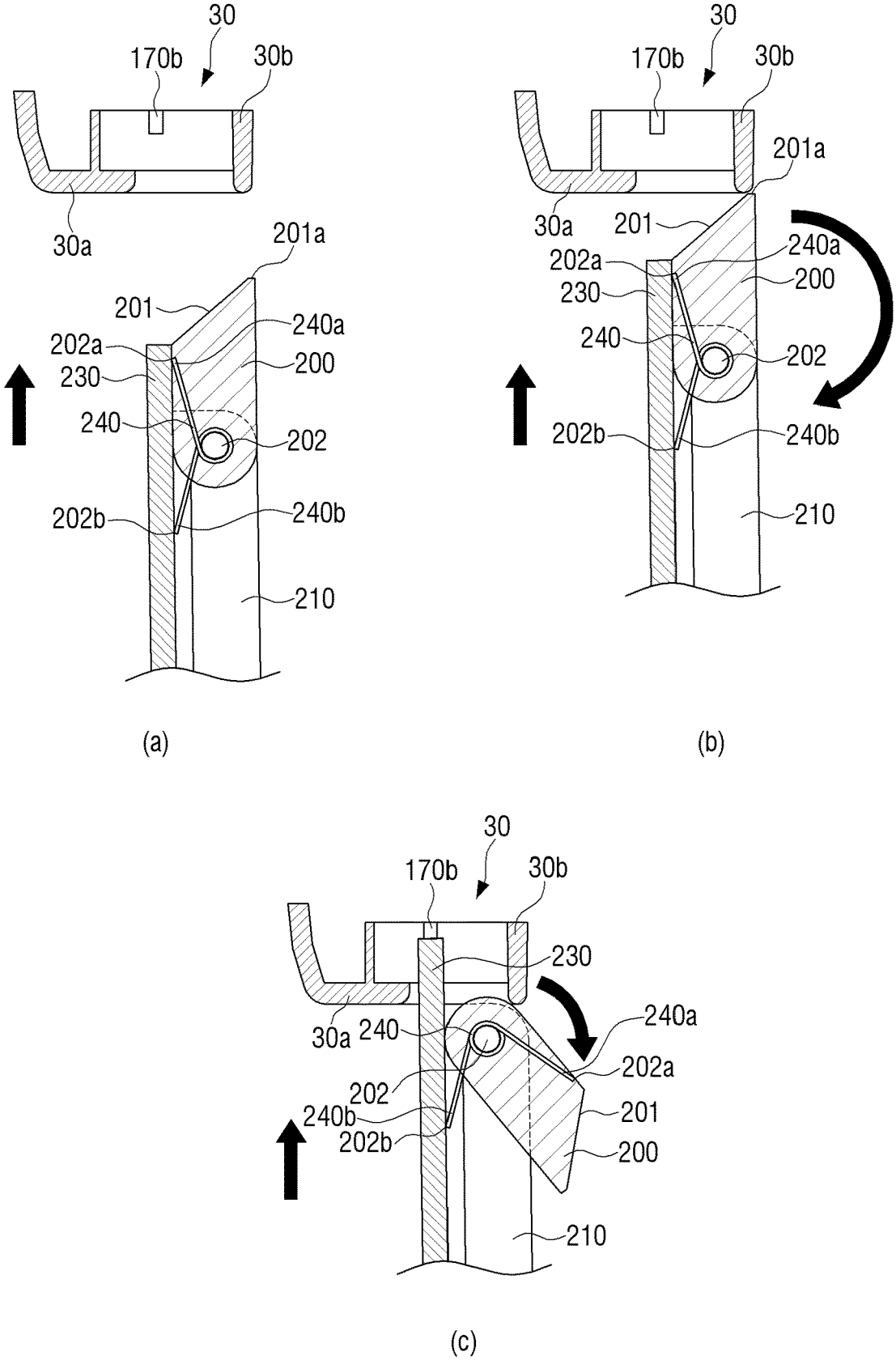
FIG. 10 is a cross-sectional view taken along line X of FIG. 8 illustrating a first lever and a push protrusion that operate according to an example.

Referring to FIG. 8, FIG. 9, and FIG. 10, a support device according to an example will be described.

A support device according to the example of FIG. 8, FIG. 9, and FIG. 10 is similar to the above described support device but further includes an example of a first lever and a push protrusion. Therefore, only the description of the first lever and the push protrusion will be made.

FIG. 8 is a perspective view illustrating a first lever and a push protrusion according to an example, FIG. 9 is a front view illustrating a support device that supports a toner cartridge tray according to an example, and FIG. 10 is a cross-sectional view taken along line X of FIG. 8 illustrating a first lever and a push protrusion that operate according to an example.

Referring to FIG. 8, FIG. 9, and FIG. 10, a first lever 200 may include a pillar 210.

The pillar 210 may protrude toward the inside 40 of the image forming apparatus 1 in connection with the inner surface 20*a* of the door 20.

The pillar 210 may be coupled with the door 20, and a cross section of the pillar may be circular, square, hexagonal, octagonal, and the like, but is not limited to a specific cross section. In an example, the pillar 210 may be integrally formed with the door 20.

A push protrusion 230 may protrude from the front end of the pillar 210 toward the inside 40 of the image forming apparatus 1.

The push protrusion 230 may be coupled with the pillar 210. In an example, the push protrusion 230 may be integrally formed with the pillar 210.

The push protrusion 230 may press the switch 170*b* of the sensor 170 for sensing the opening or closing of the door 20 while the first lever 200 is rotated, and a front end of the push protrusion 230 may be disposed under a front end of the first lever 200 so that the operation of the first lever 200 may not be interfered.

The first lever 200 may be rotatably connected to the front end of the pillar 210 by a hinge protrusion 202.

Referring to FIG. 10, a first position may be defined such that a front end 201*a* of the first lever 200 is toward the inner surface 20*a* of the door 20. A second position may be defined such that the front end 201*a* of the first lever 200 is toward the internal structure 30 of the image forming apparatus 1.

The first lever 200 may rotate between the first and second positions by 180 degrees based on the hinge protrusion 202.

The first lever 200 may further include a first elastic member for rotating the first lever 200 from the first position to the second position.

An example of the first elastic member is a torsion spring 240, but the first elastic member is not limited thereto. Any type of elastic member may be used as long as it causes movement of the first lever 200 from the first position to the second position.

According to an example, the torsion spring 240 will be exemplified as the first elastic member for connecting the first lever 200 to the pillar 210.

The torsion spring 240 may be coupled with the hinge protrusion 202 of the first lever 200.

One end 240*a* of the torsion spring may be connected to an inner wall 202*a* of the first lever 200, and another end 240*b* of the torsion spring 240 may be connected to an inner wall 202*b* of the pillar 210.

When the door 20 is opened, the first lever 200 may automatically rotate from the first position to the second position by elasticity or restoring force of the torsion spring 240.

Referring to FIG. 9, when the first lever 200 is disposed at the second position, the first lever 200 may support the left and right sides 10*c* and 10*d* of the toner cartridge tray 10 together with the second lever 110 to prevent the toner cartridge tray 10 from moving in the direction of x1 or x2.

Referring to FIG. 10, the operations of the first lever 200 and the push protrusions 200 and 230 according to an example will be described when the door 20 is closed.

As the door 20 is opened, the first lever 200 that is hingedly connected to the front end of the pillar 210 may rotate by 180 degrees from the first position to the second position by the torsion spring 240 provided in the hinge protrusion 202 of the first lever.

Referring to frame (a) of FIG. 10, when the door 20 including the first lever 200 is closed, such as by an external force, the first lever 200, the pillar 210, and the push protrusion 230 may approach the internal structure 30.

The left frame 30*a* and the first contact part 30*b* may be formed in the internal structure 30 of the image forming apparatus 1, and the switch 170*b* of the sensor 170 for sensing the opening or closing of the door 20 may be disposed to protrude.

Referring to frame (b) of FIG. 10, as the door 20 is close to the internal structure 30, the front end 201*a* of the first lever 200 may contact the first contact part 30*b* of the internal structure 30.

The first contact part 30*b* may contact a slope 201 formed in the first lever 200 and press the first lever 200 to rotate based on the hinge protrusion 202.

Referring to frame (c) of FIG. 10, the first lever 200 pressed by the first contact part 30*b* may rotate to the first position, and the shape of the torsion spring 240 provided in the hinge protrusion 202 may be changed.

The push protrusion 230 formed at the front end of the pillar 210 while the first lever 200 rotates to the first position may be close to the switch 170*b*.

As the door 20 is completely closed, the push protrusion 230 may press the switch 170*b*, and the switch 170*b* may be pushed by the push protrusion 230. The sensor 170 may sense that the door 20 is closed.

The first lever 200 may be hingedly connected to the front end of the pillar 210, and the push protrusion 230 may be integrally embodied at the front end of the pillar 210. Thus, the first lever 200 and the push protrusion 230 may be combined with the pillar 210.

Therefore, the support device according to an example has a simple configuration, and there is no need to add a separate push protrusion, thereby reducing manufacturing cost and process.

In addition, it is not necessary to increase the inner space of the image forming apparatus 1 because there is no need to add a separate space for a push protrusion.

Figure 11:
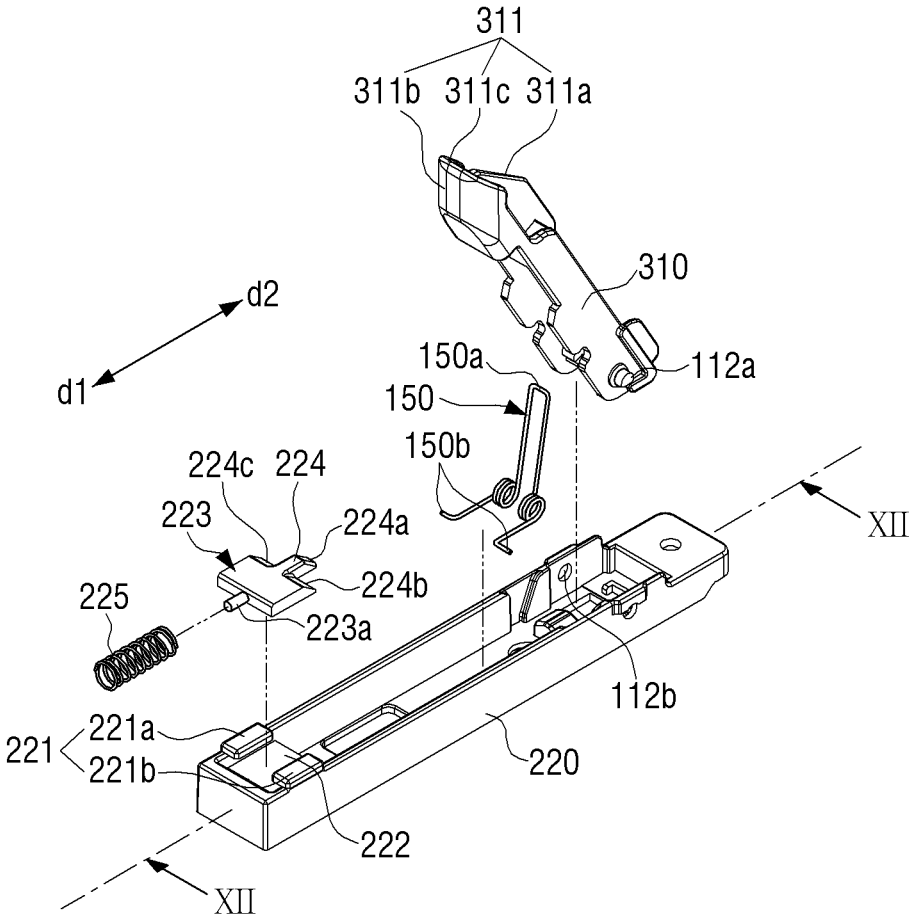
FIG. 11 is an exploded perspective view illustrating a second lever according to an example.
Figure 12:
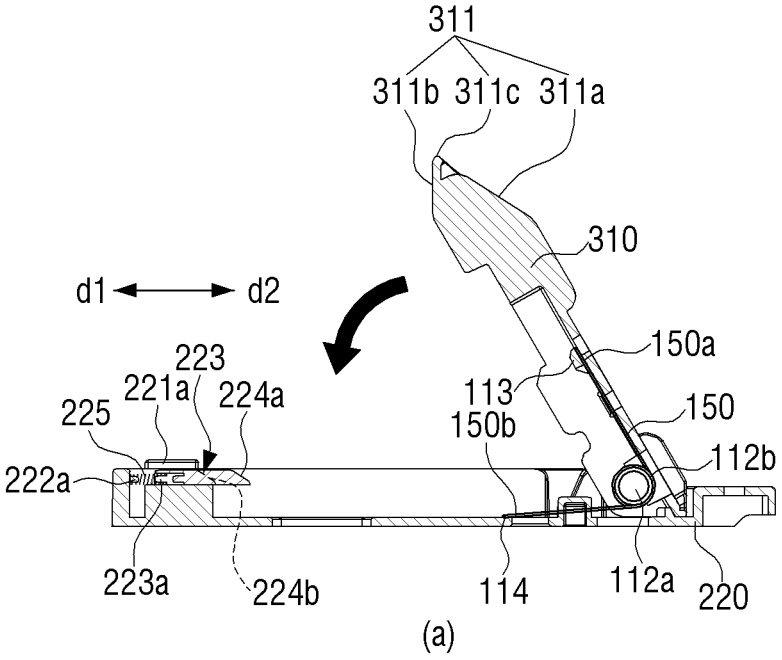
FIG. 12 is a cross-sectional view taken along line XII of FIG. 11 illustrating an operation state of a second lever according to an example.
Figure 12:
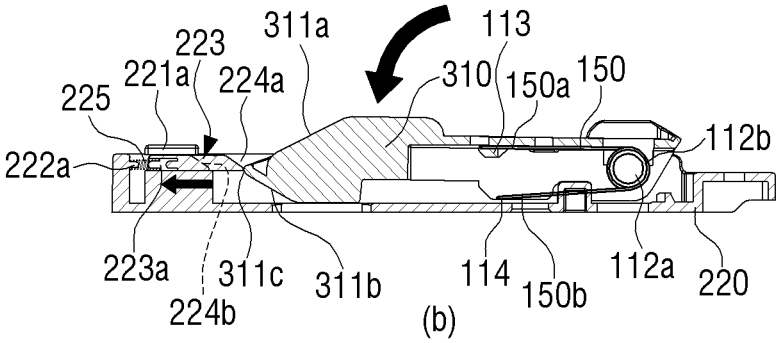
Figure 12:
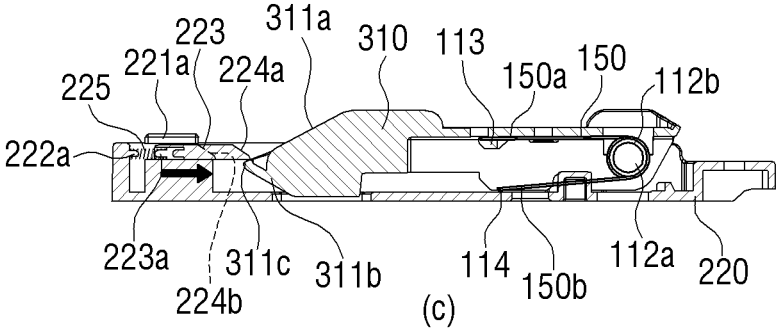
Figure 13:
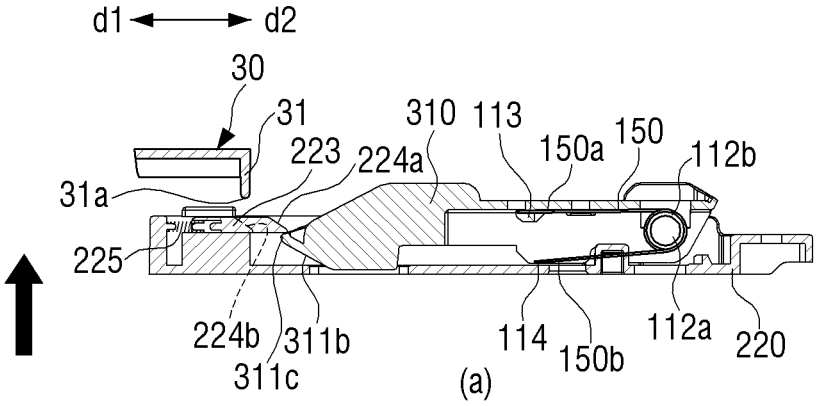
FIG. 13 is a cross-sectional view illustrating a process in which a second lever is unlocked according to an example.
Figure 13:
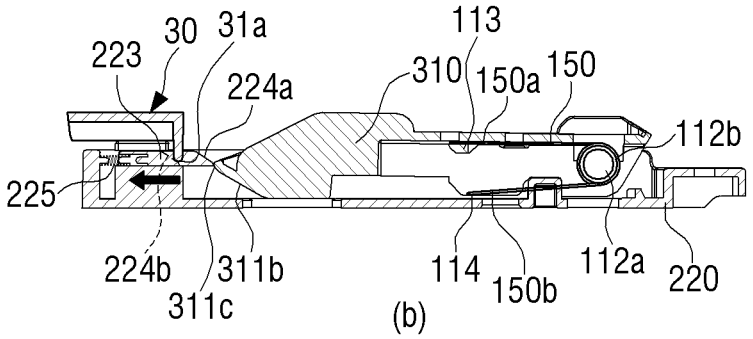

Referring to FIG. 11, FIG. 12, and FIG. 13, a support device according to an example will be described.

A support device according to the example of FIG. 11, FIG. 12, and FIG. 13 is similar to the above described support device but further includes an example of a holder for housing a second lever. Therefore, only the description of the holder will be made.

FIG. 11 is an exploded perspective view illustrating a second lever according to an example, FIG. 12 is a cross-sectional view taken along line XII of FIG. 11 illustrating an operation state of a second lever according to an example, and FIG. 13 is a cross-sectional view illustrating a process in which a second lever is unlocked according to an example.

Referring to FIG. 11, a second lever 310 may include a slope 311 formed at a front end thereof in a length direction, and the slope 311 may include a forward slope 311*b* and a rearward slope 311*a*.

The rearward slope 311*a* may contact the internal structure 30 of the image forming apparatus 1 and may rotate the second lever 310 from the fourth position to the third position.

The forward slope 311*b* may slide a locking member 223 in a direction of d1.

The second lever 310 may further include a holder 220, and the holder 220 may be provided on the inner surface 20*a* of the door 20.

The holder 220 may be coupled with the inner surface 20*a* of the door 20. In an example, the holder 220 is integrally formed with the inner surface 20*a* of the door 20, but it is not limited thereto. That is, it is also possible to manufacture the holder 220 separately and connect it to the inner surface 20*a* of the door 20.

The second lever 310 may be hingedly connected to the holder 220.

The second lever 310 may include a hinge protrusion 112*a* formed therein, and a hinge hole 112*b* may be formed in the holder 220. The hinge protrusion 112*a* may be inserted into the hinge hole 112*b* and may form a rotational axis for rotating the second lever 310.

The third position may be defined such that the second lever 310 is located in parallel with the door 20, and provided in the holder 220.

The fourth position may be defined such that the second lever 310 may rotate at a predetermined angle with the inner surface 20*a* of the door 20 or the holder 220 and support the toner cartridge tray 10.

The holder 220 may include an engagement part 221, a sliding part 222, and the locking member 223.

The engagement part 221 and the sliding part 222 may be arranged at one end of the holder 220, and the locking member 223 may be mounted on the sliding part 222 to be slid.

The engagement part 221 may further include deviation prevention members 221*a* and 221*b* and may be coupled with the holder 220. In an example, the deviation prevention members 221*a* and 221*b* and may be integrally formed with the holder 220.

The deviation prevention members 221*a* and 221*b* may cover the upper surface of the locking member 223, and the locking member 223 may be limited to move in a vertical direction from the sliding part 222.

The locking member 223 may be elastically supported from an inner wall of the holder 220 by a third elastic member to be slid.

The third elastic member for elastically supporting the locking member 223 is embodied as a coil spring 225, but is not limited thereto. Any type of elastic member may be used as long as the locking member 223 can be supported elastically by one end of the holder 220.

According to an example, the coil spring 225 will be exemplified as a third elastic member.

Referring to FIG. 12, one end of the coil spring 225 may be connected to a first coupling protrusion 222*a* formed in the inner wall of the holder 220. The other end of the coil spring 225 may be connected to a second coupling protrusion 223*a* formed in the locking member 223.

Therefore, the locking member 223 may be elastically supported at one end of the holder 220 by the coil spring 225 to slide between d1 and d2 on the sliding part 222 back and forth.

Referring to FIG. 1, FIG. 11, and FIG. 12, an example operation in which the second lever 310 is locked to the holder 220 will be described.

The toner cartridge tray 10 may include a plurality of developers (not shown).

When one or more of the plurality of developers needs to be replaced, it may be replaced more easily by separating the toner cartridge tray 10 including the plurality of developers (not shown) from the image forming apparatus 1.

In the toner cartridge tray 10, toner may be scattered from a developer and interrupt a normal operation of the image forming apparatus 1. Therefore, the toner cartridge tray 10 may need to be completely separated from the image forming apparatus 1 to clean the scattered toner.

The toner cartridge tray 10 may be completely separated from the guide rail 12 provided in the image forming apparatus 1.

However, as described above, the toner cartridge tray 10 of the image forming apparatus 1 may include a guide 11 disposed on the left side 10*c* and the right side 10*d*, and a deviation prevention hook 11*a* to prevent the guide 11 from being deviated from the guide rail 12.

When the stopper 12*a* to be engaged with the deviation prevention hook 11*a* is formed in the guide rail 12, and the toner cartridge tray 10 moves to the outside, the stopper 12*a* may prevent the toner cartridge tray 10 from being deviated.

Therefore, in order to completely separate the toner cartridge tray 10 from the image forming apparatus 1, it is necessary to move the toner cartridge tray 10 in the direction of x1 or x2 by an external force and release the engagement between the deviation prevention hook 11*a* and the stopper 12*a*.

In order to completely separate the toner cartridge tray 10 from the image forming apparatus 1, the door 20 needs to be opened.

The second lever 310 may be disposed at the fourth position because the door 20 is opened, and the second lever 310 may suppress the movement of the toner cartridge tray 10 in the direction of x1 or x2.

Therefore, the engagement between the deviation prevention hook 11*a* and the stopper 12*a* may be released by placing the second lever 310 at the third position and moving the cartridge tray 10 in the direction of x1 or x2.

When the door 20 is opened, the second lever 310 may be automatically rotated to the fourth position by the torsion spring 150, and thus the locking member 223 is needed so that the second lever 310 may not rotate to the fourth position, but may stay at the third position Referring to FIG. 11, a forward protrusion 224 may be formed in the locking member 223. In the example of FIG. 11, the forward protrusion 224 protrudes from the center of the locking member 223, but the disclosure is not limited thereto.

A first slope surface 224*a* may be formed at the front end of the forward protrusion 224, and second slope surfaces 224*b* and 224*c* may be formed on both sides of the forward protrusion 224.

The first slope surface 224*a* and the second slope surfaces 224*b* and 224*c* formed on the forward protrusion 224 may slide the locking member 223 in the direction of d1.

Referring to frame (a) of FIG. 12, the forward slope 311*b* may be formed on a front end 311*c* of the second lever 310.

A user may apply an external force to the second lever 310 to move the second lever 310 to the third position, and the second lever 310 may rotate from the fourth position to the third position.

Referring to frame (b) of FIG. 12, the forward slope 311*b* formed on the front end 311*c* of the second lever 310 may contact the first slope surface 224*a* formed in the forward protrusion 224.

While the second lever 310 is rotated to the third position by an external force from a user, the forward slope 311*b* formed at the front end 311*c* of the second lever 310 may contact the first slope surface 224*a* formed on the forward protrusion 224.

The locking member 223 in which the forward protrusion 224 is formed may be pushed in the direction of d1 by the front end 311*c* of the second lever 310.

A size of the coil spring 225, of which the other end thereof is connected to the coupling protrusion 223*a* of the locking member 223, may be reduced by a force to push the locking member 223 by the front end 311*c* of the second lever 310.

Referring to frame (c) of FIG. 12, a distance between the front end 311*c* of the second lever 310 and the first slope surface 224*a* formed on the forward protrusion 224 may increase while the locking member 223 slides in the direction of d1, and the front end 311*c* of the second lever 310 may be deviated from the first slope surface 224*a* formed on the forward protrusion 224.

The second lever 310 may move to the third position, and a force to push the first slope surface 224*a* formed on the forward protrusion 224 in the direction of d1 may be reduced or eliminated.

Therefore, the locking member 223 may not push in the direction of d1 any further, but may slide in the direction of d2 by the elastic force of the coil spring 225.

When the locking member 223 slides a predetermined distance in the direction of d2, the forward protrusion 224 formed on the locking member 223 may be disposed at the front end 311*c* of the second lever 310.

Due to the forward protrusion 224 formed on the locking member 223 disposed at the front end 311*c* of the second lever 310, the rotation of the second lever 310 from the third position to the fourth position may be suppressed despite the elastic force of the torsion spring 150.

When the second lever 310 is in the third position, a user may move the toner cartridge tray 10 in the direction of x1 or x2, release the engagement between the deviation prevention hook 11*a* and the stopper 12*a*, and completely separate the toner cartridge tray 10 from the image forming apparatus 1.

Referring to FIG. 13, an example operation in which the second lever 310 is unlocked from the holder 220 will be described.

When the toner cartridge tray 10 is mounted on the guide rail 12 of the image forming apparatus 1 and pushed into the inside 40, the locking member 223 needs to be unlocked.

Accordingly, when the door 20 is opened again, the second lever 310 may be rotated to the fourth position to support the toner cartridge tray 10.

However, if an additional device is further included for unlocking the locking member 223, the entire volume and size of the image forming apparatus 1 may be increased.

Therefore, the locking member 223 moves in the direction of d1 by using the internal structure 30 of the image forming apparatus 1 when the door 20 is closed.

The internal structure 30 of the image forming apparatus 1 may further include a boss 31 for moving the locking member 223 in the direction of d1 in contact with the locking member 223.

The boss 31 may be coupled with the internal structure 30 and formed to protrude from the internal structure 30. In an example, the boss 31 may be integrally formed with the internal structure 30.

A front end 31*a* of the boss 31 may be arranged to contact the second slope surfaces 224*b* and 224*c* when the locking member 223 locks the second lever 310.

Referring to frame (a) of FIG. 13, when the door 20 is closed by an external force in a state in which the second lever 310 is locked by the locking member 223 at the third position, the front end 31*a* of the boss 31 may be close to the second slope surfaces 224*b* and 224*c* formed on the locking member 223.

Referring to frame (b) of FIG. 13, when the door 20 is close to the internal housing 30, the front end 31*a* of the boss 31 may contact the second slope surfaces 224*b* and 224*c* formed in the locking member 223.

The front end 31*a* of the boss 31 may contact the second slope surfaces 224*b* and 224*c* of the locking member 223, and push the second slope surfaces 224*b* and 224*c* so that the locking member 223 may slide in the direction of d1.

The second slope surface 224*b* and 224*c* may be pushed in the direction of d1 by the front end 31*a* of the boss 31, and the locking member 223 may also be moved in the direction of d1.

When the locking member 223 moves in the direction of d1, the coil spring 225 that supports the locking member 223 elastically may be reduced in size.

When the locking member 223 moves a predetermined distance in the direction of d1 by the front end 31*a* of the boss 31, the forward protrusion 224 formed in the locking member 223 may be deviated from the front end 311*c* of the second lever 310, and thus the second lever 310 may be unlocked.

The front end 31*a* of the boss 31 may push the second slope surfaces 224*b* and 224*c* in the direction of d1 when the door 20 is closed, and the unlocked state of the second lever 310 may be maintained.

When the door 20 is opened, the second lever 310 may move to the fourth position in the unlocked state.

Hereinafter, referring to FIG. 14 and FIG. 15, a chamfer formed at front ends of first and second levers will be described according to an example.

Figure 14:
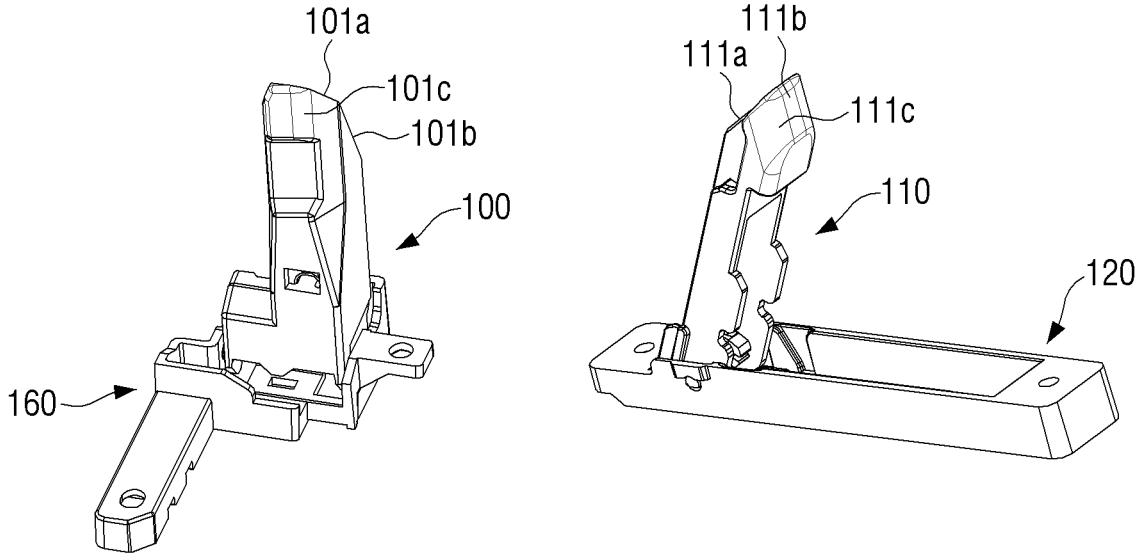
FIG. 14 is a perspective view illustrating a first lever and a second lever according to an example.
Figure 15:
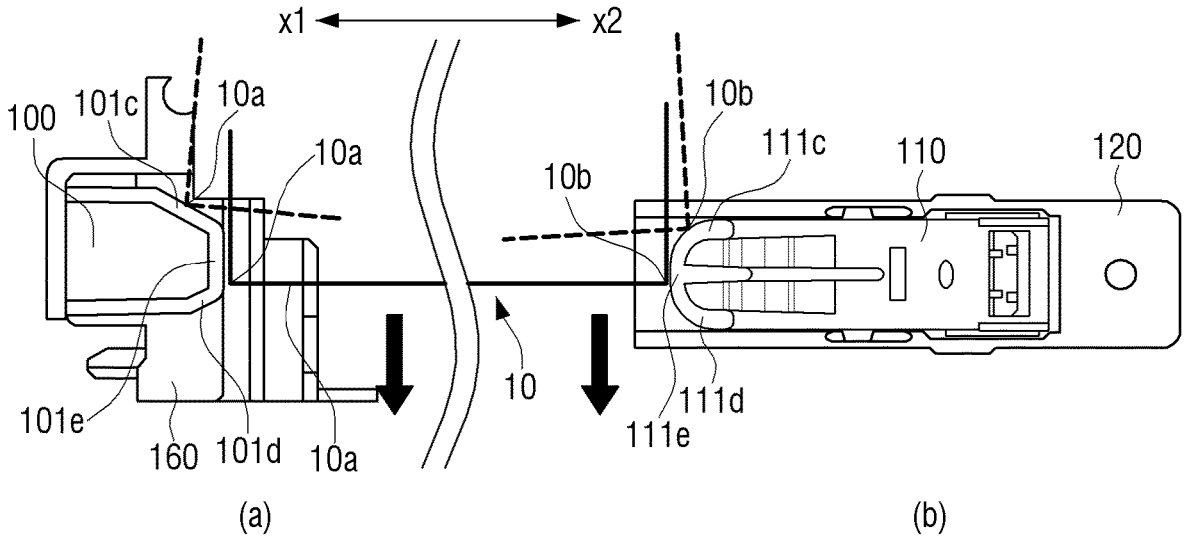
FIG. 15 is a view illustrating a toner cartridge tray that is guided by a first lever and a second lever according to an example.

FIG. 14 is a perspective view illustrating a first lever and a second lever according to an example, and FIG. 15 is a view illustrating a toner cartridge tray that is guided by a first lever and a second lever according to an example.

Referring to FIG. 14 and FIG. 15, a first chamfer 101*c* may be formed on a surface in which the first lever 100 contacts the left front end 10*a* of the toner cartridge tray 10.

A first additional chamfer 101*d* may be formed opposite to the first chamfer 101*c*.

The first chamfer 101*c* may be formed longer than the first additional chamfer 101*d*, but is not limited thereto.

A second chamfer 111*c* may be formed on a surface in which the second lever 110 contacts the right front end 10*b* of the toner cartridge tray 10.

A second additional chamfer 111*d* may be formed opposite to the second chamber 111*c*.

The second chamfer 111*c* may be formed longer than the second additional chamfer 111*d*, but is not limited thereto.

The first and second chamfers 101*c* and 111*c* may be formed in a gently inclined and/or curved shape. In addition, the first and second additional chamfers 101*d* and 111*d* may also be formed in an inclined and/or curve shape.

When the door 20 is opened, the first lever 100 moves to the second position, and the second lever 110 moves to the fourth position, the toner cartridge tray 10 may move from the inside 40 to the outside of the image forming apparatus 1.

However, after the door 20 is opened, the left and right front ends 10*a* and 10*b* of the toner cartridge tray 10 may be disposed in the inside 40 of the image forming apparatus 1. Therefore, the second position where the first lever 100 is disposed and the fourth position where the second lever 110 is disposed may be spaced apart from the left and right front ends 10*a* and 10*b*.

There is no separate support device from the position where the toner cartridge tray 10 is mounted on the inside 40 of the image forming apparatus 1 to the position where the first and second levers 100 and 110 are provided.

Therefore, until the toner cartridge tray 10 moves a predetermined distance outside the image forming apparatus 1 and the left and right sides 10*c* and 10*d* of the toner cartridge tray 10 are supported by the first and second levers 100 and 110, the toner cartridge tray 10 may move in the x1 or x2 direction.

If the toner cartridge tray 10 is moved in the x1 or x2 direction to the second position where the first lever 100 is disposed and/or the fourth position where the second lever 110 is disposed, the left and right front ends 10*a* and 10*b* of the toner cartridge tray 10 may be caught by the first and second levers 100 and 110 and can no longer move to the outside.

In order to prevent the toner cartridge tray 10 from being caught by the first and second levers 100 and 110, the first and second levers 100 and 110 may include the first and second chamfers 101*c* and 111*c* respectively having a gently inclined or/and curved shape on one surface of its front end.

Referring to FIG. 15, even if the left front end 10*a* of the toner cartridge tray 10 moves in the x1 direction and comes into contact with the first lever 100, the left front end 10*a* of the toner cartridge tray 10 may slide along a slope surface of the first chamfer 101*c* formed in the first lever 100, and the toner cartridge tray 10 may move a predetermined distance in the direction of x2.

When the toner cartridge tray 10 moves a predetermined distance in the x2 direction, the toner cartridge tray 10 may be supported and guided by one surface 101*e* of the first lever.

Even if the right front end 10*b* of the toner cartridge tray 10 moves in the x2 direction and contacts the second lever 110, the right front end 10*b* of the toner cartridge tray 10 may slide along a slope surface of the second chamfer 111*c* formed in the second lever 110, and the toner cartridge tray 10 may move a predetermined distance in the direction of x1.

When the toner cartridge tray 10 is moved a predetermined distance in the x1 direction, the toner cartridge tray 10 may be supported and guided by one surface 111*e* of the second lever 110.

Therefore, the toner cartridge tray 10 which has been moved in the x1 or x2 direction by the first and second chamfers 101*c* and 111*c* may be guided to a predetermined position and is guided by the first and second levers 100 and 110, and the lateral movement of the toner cartridge tray 10 may be effectively suppressed.

When the user moves the toner cartridge tray 10 to the outside of the image forming apparatus 1 by the first and second chamfers 101*c* and 111*c*, the toner cartridge tray 10 could be easily operated.

Although examples have been shown and described, it will be appreciated by those skilled in the art that changes may be made to these examples without departing from the principles and spirit of the examples. Accordingly, the scope of the example is not construed as being limited to the described examples, but is defined by the appended claims as well as equivalents thereto.

What is claimed is:

1. A support device, comprising:

a first lever rotatably disposed at a door provided in a body of an image forming apparatus, wherein a front end of the first lever is a free end; and a first elastic member to rotate the first lever disposed at a first position based on the door being closed to a second position based on the door being opened, wherein, at the second position, the front end of the first lever contacts a part of a toner cartridge tray pulled out from the body to support the toner cartridge tray.

2. The support device as claimed in claim 1, wherein the part of the toner cartridge tray supported by the front end of the first lever at the second position includes a left side or a right side of the toner cartridge tray.

3. The support device as claimed in claim 1, wherein a rear end of the first lever is hingedly connected to an inside of the door, and wherein a side of the front end of the first lever contacts an internal structure of the body and the first lever is rotated from the second position to the first position when the door is closed.

4. The support device as claimed in claim 3, wherein the side of the front end of the first lever is inclined along a length direction of the first lever.

5. The support device as claimed in claim 1, wherein the first lever is perpendicular to an inside of the door at the second position.

6. The support device as claimed in claim 5, wherein the first lever is coupled with a push protrusion to press a switch to sense an opening or a closing of the door.

7. The support device as claimed in claim 1, further comprising:

a second lever hingedly connected to an inside of the door and spaced apart from the first lever at a predetermined distance; and a second elastic member to rotate the second lever at a third position based on the door being closed to a fourth position based on the door being opened, wherein, at the fourth position, the second lever supports one of a left side or a right side of the toner cartridge tray that is not supported by the front end of the first lever.

8. The support device as claimed in claim 7, wherein a front end of the second lever is a free end, and a rear end is hingedly connected to the inside of the door.

9. The support device as claimed in claim 8, wherein a side of the front end of the second lever contacts an internal structure of the body and the second lever is rotated from the fourth position to the third position when the door is closed.

10. The support device as claimed in claim 9, wherein the side of the front end of the second lever is inclined along a length direction of the second lever.

11. The support device as claimed in claim 7, further comprising:

a holder in which the second lever is accommodated in the inside of the door; and a locking member elastically and slidably coupled to one end of the holder, wherein the locking member couples a front end of the second lever to maintain the second lever at the third position based on the second lever being accommodated in the holder.

12. The support device as claimed in claim 11, further comprising:

a boss coupled to an internal structure of the body to contact the locking member, wherein the locking member includes an inclined surface to contact the second lever, and another inclined surface to contact the boss, the locking member to be retracted by the contact of the inclined surface with the boss to unlock the second lever.

13. The support device of claim 1, further comprising:

a pillar non-rotatably coupled with the door, wherein the first lever is rotatably coupled to a front end of the pillar.

14. The support device of claim 13, further comprising:

a push protrusion coupled with the pillar and protruding from the front end of the pillar to press a switch on an inside of the body to sense an opening or closing of the door.

15. The support device of claim 13, further comprising:

a hinge protrusion coupled with the front end of the pillar, wherein the first lever is rotatably coupled to the front end of the pillar through the hinge protrusion, and wherein the first elastic member comprises a torsion spring.

16. The support device of claim 13, wherein a cross section of the pillar includes a circular shape, a square shape, a hexagonal shape, or an octagonal shape.

17. The support device of claim 13, wherein the pillar protrudes toward an inside of the body when the door is closed.

18. An image forming apparatus, comprising:

a body;

a door provided on one side of the body;

a sensor disposed in an inside of the body and including an on-off sensor for sensing an opening or a closing of the door;

a photosensitive medium on which an electrostatic latent image is formed;

a developing unit to form the electrostatic latent image of the photosensitive medium into a visible image;

a transfer unit to transfer the visible image to a recording medium;

a fixing unit to fix the visible image transferred to the recording medium;

a toner cartridge tray on which the developing unit is mounted, the toner cartridge tray being disposed to be pulled out from or put into the body; and a support device disposed at a first position based on the door being closed, the support device including a first lever rotated to a second position by an elastic force based on the door being opened, wherein, at the second position, a free first end of the first lever contacts a part of a toner cartridge tray pulled out from the body to support the toner cartridge tray.

19. The image forming apparatus as claimed in claim 18, further comprising:

a second lever arranged at a third position based on the door being closed, and rotated to a fourth position by an elastic force based on the door being opened, wherein, at the fourth position, the second lever supports one of a left side or a right side of the toner cartridge tray that is not supported by the front end of the first lever.

20. The image forming apparatus as claimed in claim 19, further comprising:

a holder in which the second lever is accommodated in an inside of the door; and a locking member elastically and slidably coupled to one end of the holder, wherein the locking member contacts a front end of the second lever to maintain the second lever at the third position based on the second lever being accommodated in the holder.

* * * * *